US008172228B2

(12) United States Patent
Huala et al.

(10) Patent No.: US 8,172,228 B2
(45) Date of Patent: May 8, 2012

(54) INTEGRATED MODULE

(75) Inventors: Rob Huala, Tualatin, OR (US); Jos Jacobs, Sherwood, OR (US); David B. Schaefer, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 517 days.

(21) Appl. No.: 12/412,172

(22) Filed: Mar. 26, 2009

(65) Prior Publication Data

US 2010/0247214 A1 Sep. 30, 2010

(51) Int. Cl.
*B65H 39/10* (2006.01)

(52) U.S. Cl. ..... 271/303; 271/225; 271/184; 271/186

(58) Field of Classification Search ..... 271/303, 271/225, 184–186, 208
See application file for complete search history.

(56) References Cited

U.S. PATENT DOCUMENTS

| | | | | |
|---|---|---|---|---|
| 5,180,232 | A | 1/1993 | Chadima, Jr. et al. | |
| 5,586,758 | A * | 12/1996 | Kimura et al. | 271/303 |
| 6,129,349 | A * | 10/2000 | Olbrich et al. | 271/186 |
| 6,190,070 | B1 | 2/2001 | Urban et al. | |
| 6,241,239 | B1 * | 6/2001 | Oberhoffner et al. | 271/208 |
| 6,296,244 | B1 | 10/2001 | Hanks et al. | |
| 6,892,048 | B2 | 5/2005 | Eskey | |
| 6,926,272 | B2 | 8/2005 | Carter et al. | |
| 6,973,279 | B2 * | 12/2005 | Yokoi | 399/124 |
| 7,093,831 | B2 * | 8/2006 | Biegelsen et al. | 271/184 |
| 7,108,260 | B2 * | 9/2006 | Biegelsen et al. | 271/303 |
| 7,185,888 | B2 * | 3/2007 | Duff et al. | 271/303 |
| 2003/0116911 | A1 * | 6/2003 | Kanai | 271/303 |

* cited by examiner

*Primary Examiner* — Michael McCullough
*Assistant Examiner* — Luis A Gonzalez
(74) *Attorney, Agent, or Firm* — Maginot, Moore & Beck, LLP

(57) ABSTRACT

An integrated module for installation within a printer may include a module frame and a plurality of printer subsystem components. The module frame is configured to fit within a predetermined space within a printer and to connect to a printer frame positioned about the predetermined space. The plurality of printer subsystem components are configured to mount to the module frame. At least one printer subsystem component includes a default module media path and at least one diverter-directed module media path within the printer subsystem component. The at least one printer subsystem component is configured to connect to the module frame at a position that enables the default module media path and the at least one diverter-directed module media path to complete a printer media path through the predetermined space when the module frame having the printer subsystem component is connected to the printer frame.

10 Claims, 3 Drawing Sheets

INTEGRATED MODULE

TECHNICAL FIELD

The apparatus described below relates to subsystems within printers and, more particularly, to subsystems that handle media within a printer.

BACKGROUND

In a typical printer, media trays store media sheets within the printer. During the printing cycle, a media transport system retrieves media sheets from an input media tray, routes the media sheets along a media path to receive and fix an image on the media sheets, and transports the media sheets to an output media tray or bin for collection by a user. The media path in most printers is formed by a series of printer subsystems coupled to a printer frame in a way that enables a media sheet to be transported through the subsystems and their interfaces. For example, a printer may include a subsystem for stripping media sheets from the input media tray; an imaging subsystem for applying and fixing an image to the media sheets; a finishing subsystem that may staple, stack, or collate media sheets; and an exit path subsystem for selectively routing media sheets with an image thereon to either the output media tray or the finishing subsystem.

Each printer subsystem requires a combination of components, such as motors, lamps, charging devices, fusing rolls, drive rollers, idler rollers, or other electromechanical devices. In some printers, the components forming each subsystem are attached to the printer frame individually, a process referred to herein as a piecemeal assembly process. For instance, the imaging subsystem of a printer may contain many components and each component may require an individual connection, configuration, and alignment in order to enable the imaging subsystem to function properly and to cooperate with the other printer subsystems.

Even though the media path of a printer may be described as a series of subsystems, often the piecemeal assembly process blurs the integrity of the subsystems and the physical distinction between subsystems. Specifically, the location and connection of the individual subsystem components may result in an overlap between printer subsystems and a meshing of the individual subsystems with the surrounding subsystems. Thus, one printer subsystem is difficult to distinguish from another subsystem. While the piecemeal assembly process of printer subsystems results in an operable and functional printer, identification of subsystem interfaces may be difficult.

SUMMARY

The components of a printer subsystem may be connected to a module frame that may be connected to a printer frame as an integrated and modular unit. An integrated module for installation within a printer may include a module frame and a plurality of printer subsystem components. The module frame is configured to fit within a predetermined space within a printer and to connect to a printer frame positioned about the predetermined space. The plurality of printer subsystem components are configured to mount to the module frame. At least one printer subsystem component includes a default module media path and at least one diverter-directed module media path within the printer subsystem component. The at least one printer subsystem component is configured to connect to the module frame at a position that enables the default module media path and the at least one diverter-directed module media path to complete a printer media path through the predetermined space when the module frame having the printer subsystem component is connected to the printer frame.

A printer for fixing an image upon a media sheet may include a printer subsystem that may be connected to a module frame that may be connected to a printer frame as an integrated and modular unit. The printer includes an imaging apparatus, a predetermined space, an integrated module, and a plurality of printer subsystem components. The imaging apparatus is mounted to the printer frame and is configured to fix an image to a media sheet and to transport the media sheet along one or more printer media paths. The predetermined space is defined by a printer frame. The integrated module includes a module frame configured to fit within the predetermined space. The module frame may be connected to the printer frame within the predetermined space. The plurality of printer subsystem components are configured to mount to the module frame. At least one printer subsystem component includes a default module media path and at least one diverter-directed module media path within the printer subsystem component. The at least one printer subsystem component is configured to connect to the module frame at a position that enables the default module media path and the at least one diverter-directed module media path to complete a printer media path through the predetermined space when the module frame having the printer subsystem component is connected to the printer frame.

A method of integrating printer subsystem components connects a plurality of printer subsystem components to a frame of an integrated module. At least one printer subsystem component defines a default module media path and at least one diverter-directed module media path. The method also includes positioning the plurality of printer subsystem components connected to the integrated module within a printer by connecting the frame of the integrated module as a single unit to a predetermined space defined by a frame of the printer. The method further includes completing a printer media path through the predetermined space with the default module media path and the at least one diverter-directed module media path when the module frame having the at least one printer subsystem component is connected to the printer frame.

DETAILED DESCRIPTION

Figure 1:
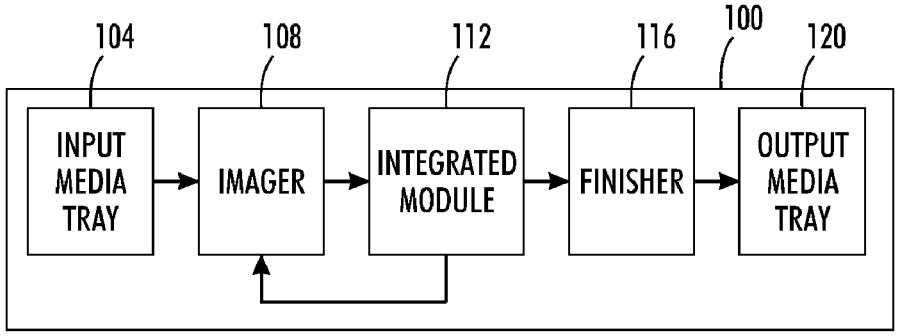
FIG. 1 depicts a block diagram of a printer.
Figure 2:
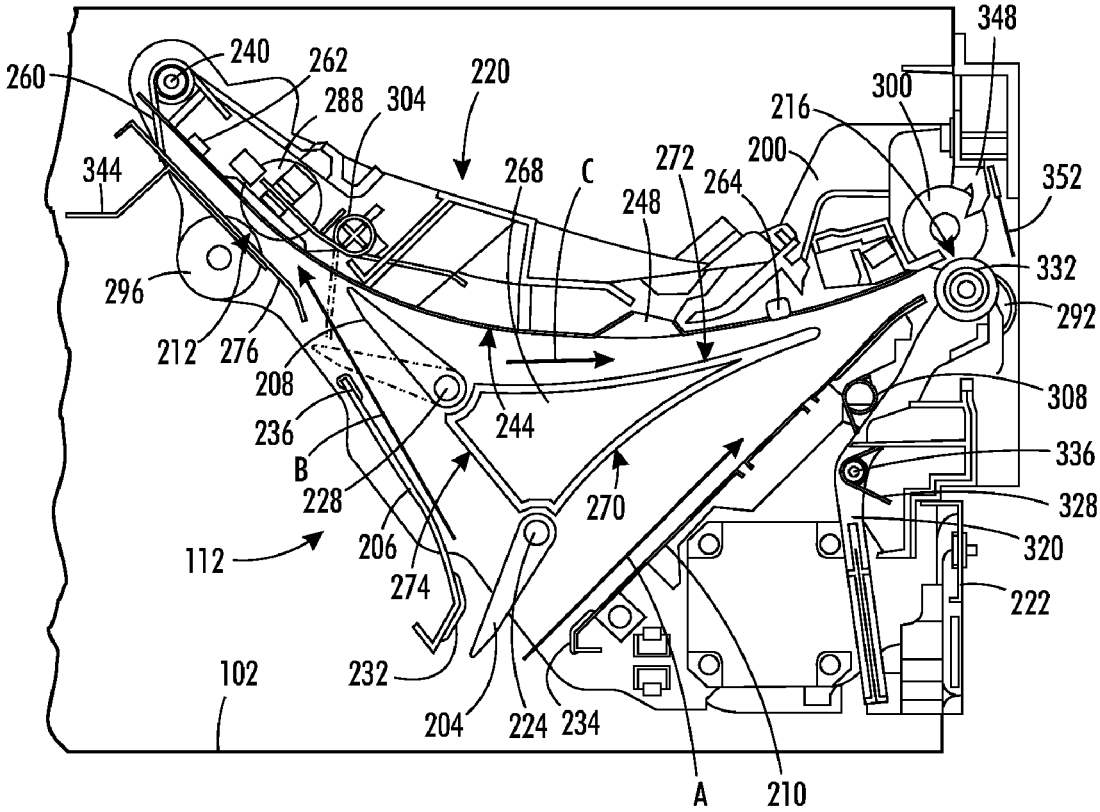
FIG. 2 depicts a cross sectional view of an integrated module for use with a printer as depicted in FIG. 1.

The integrated module described herein is suitable for connection to a printer 100. The term "printer" refers, for example, to reproduction devices in general, such as printers, facsimile machines, copiers, and related multi-function products. Illustrated in FIG. 1 is a block diagram of a printer 100 for applying and fixing an image upon a media sheet. The printer 100 includes a frame 102 (as shown in FIG. 2) upon which printer 100 subsystems are connected. The subsystems are coupled to the printer frame 102 in a manner that defines a predetermined space in the printer 100. The predetermined space is an area or volume approximately the same size and shape as the integrated module 112. The integrated module 112 is configured to fit within the predetermined space and to connect to the printer frame 102. Exemplary printer 100 subsystems that may define the predetermined space include an input media tray 104, an imager 108, a finisher 116, an output media tray 120, as well as other printer subsystem components.

The input media tray 104 supports a supply of print media, referred to as media sheets, for use in the printer 100. The input media tray 104 may be connected to the printer frame 102 in a position that permits the input media tray 104 to be restocked with additional media sheets. Depending on the embodiment, the input media tray 104 may support only a few media sheets. Alternatively, the input media tray 104 may support as many as a few thousand media sheets. A media transport device strips media sheets from the input media tray 104 and routes the media sheets to the imager 108 along a portion of a printer media path.

The imager 108 applies and fixes an image to a media sheet. The imager 108 may include any known print imaging device including, but not limited to, solid ink, aqueous ink, and electrostatic imaging systems. Accordingly, an image may be applied to a media sheet by the imager 108 directly or indirectly. After applying an image to a media sheet, the media transport device routes the media sheet to the integrated module 112, which is described in more detail below.

The finisher 116 may perform various functions upon media sheets as they exit the integrated module 112. Exemplary finishers 116 include staplers, collating or sorting devices, high volume finishers, and stacking devices. After processing the media sheets, the finisher 116 may direct the media sheets to the output media tray 120, which supports the media sheets until they are collected by a user.

The integrated module 112 is shown in greater detail in FIG. 2. The integrated module 112 may receive media sheets from a printer device, such as the imager 108, along module media path A, which may be referred to as a default module media path. Media sheets received along module media path A are routed into contact with roller pair 216, which propels the media sheets into the output media tray 120 or a finisher 116. Alternatively, the integrated module 112 may be configured to receive and route media sheets along module media paths B and C, which may be referred to in whole as a diverter-directed module media path. In particular, media sheets may be routed with a first media routing diverter along module media path B and into contact with roller pair 212. Additionally, media sheets may be received and routed with a second media routing diverter along module media path C, which may be used to reverse the orientation of the media sheets or propel the media sheet into contact with roller pair 216. Accordingly, the integrated module 112 operates to receive and route media sheets to one of at least two module media paths to complete a printer media path that extends through the predetermined space in the printer 100. Each component of the integrated module 112 is explained below in detail.

The media routing diverters, which may be referred to as gates, may be one or more rollers capable of altering media flow from the default module media path to a different module media path or it may be a fixed or movable blade, gate, series of finger-like features or a panel. The functioning of the media routing diverters may be passive, such as influenced by media size or media travel direction. Alternatively, the media routing diverters may be actuated to alter the media path, such as by activating a controller and solenoid or by repositioning a panel, cover, or receiving tray. Examples of diverted media paths include reversing direction through an alternate module path and routing media sheets to a finisher or stacker rather than a stationary tray. Adding or changing optional finishers may influence an alternate module media path through the integrated module 112. The default module media path is one leading to a default media output location such as an output media tray 120 or a finisher 116.

Furthermore, while media routing diverters are described extensively as movable diverters 204, 208, the diverters may take many forms. For example, the diverters 204, 208 may be positioned or actuated by a driven mechanism. Alternatively, the diverters 204, 208 may be stationary, passive, or manually moved. Additionally, the position of the diverters 204, 208 may be altered based on the cover 220 position or as a consequence of the position or presence of optional components coupled to the integrated module 112 or the printer 100.

The integrated module 112 includes a module frame 200, a media guide unit 268, a first media routing diverter provided as movable diverter 204, a second media routing diverter provided as movable diverter 208, a first roller pair 212, a second roller pair 216, a cover assembly 220, a connecting plate 222, as well as other components. Each component of the integrated module 112 is configured to be properly positioned within the predetermined space within the printer 100 when the integrated module 112 is connected to the printer frame 102.

The module frame 200 is the portion of the integrated module 112 secured to the printer frame 102. The module frame 200 may be formed of various materials including, but not limited to, plastic, sheet metal, and carbon fiber. The printer frame 102 includes openings (not illustrated) through which fastening members, such as bolts, studs, or plastic fasteners, may be used to secure the module frame 200 to the printer frame 102. The module frame 200 is appropriately configured to fit within the predetermined space of the printer 100 and to position the components of the integrated module 112 at the locations that enable them to perform their function and properly interact with adjacent subsystems. Thus, the module frame 200 enables the components secured to the integrated module 112 to be integrated into the printer 100 as a single unit rather than requiring each component to be installed in the piecemeal fashion described above. Furthermore, module frame 200 is configured to align the module media paths A, B, C with a printer media path or paths through the predetermined space.

As illustrated in FIG. 2, the integrated module 112 includes at least one printer subsystem component having media guide surfaces that define the module media paths A, B, and C. The media guide surfaces route and/or support media sheets as they move along the module media paths A, B, C. Accordingly, the media guide surfaces should be free from surface abrasions and irregularities that may catch, snag, or jam a media sheet in motion thereon. The media guide surfaces may be components or elements having a role limited to defining a module media path A, B, C. Alternatively, the media guide surfaces may be portions of the printer subsystem components having at least a dual role, such as the underside of the cover assembly 220, which forms a portion of module media path C and also supports elements of the cover assembly 220. Various materials may be used to form the media guide surfaces including, but not limited to, plastic, metal, and carbon fiber.

The media guide unit 268 includes three media guide surfaces 270, 272, 274 that form boundaries of module media paths A, B, C. In particular, the upper surface of module media path A is defined by media guide surface 270 and movable diverter 204, and the lower surface of module media path A is defined by media guide surface 210. Likewise, the upper surface of module media path B is defined by media guide surface 274, movable diverter 204, and movable diverter 208. The lower surface of module media path B is defined by media guide surface 206 and media guide surface 276. Furthermore, the upper surface of module media path C is defined by media guide surface 244, and the lower surface of module media path C is defined by movable diverter 208 and media guide surface 272. Media sheets are routed between the upper and lower media guide surfaces of the module media paths A, B, C, but not necessarily in the same operation.

The movable diverters 204, 208 route the flow of media sheets through the default module media path, media path A, and the diverter-directed module media path, media paths B and C. In particular, the diverters 204, 208 are capable of reversing the direction of media sheets passing through the integrated module 112, routing media sheets to a finisher 116 or stacker, routing media sheets to the output media tray 120, as well as other related functions.

The diverters 204, 208 are pivotally coupled to the media guide unit 268. As illustrated in FIG. 2, a pivot rod 224 connects the first movable diverter 204 to the media guide unit 268 at a pivot point located at the beginning of module media paths A and B. Likewise, a pivot rod 228 connects the second movable diverter 208 to the media guide unit 268 at a pivot point located at the end of module media path B and at the beginning of module media path C. The first and second diverters 204, 208 may be aligned and configured upon the media guide unit 268 before the module 112 is connected to the printer frame 102. The diverters 204, 208 do not require further configuration after the module 112 is secured to the printer 100. Stated differently, the diverters 204, 208 are operable when the module 112 is secured to the printer 100.

Each diverter 204, 208 includes an upper and lower surface configured to guide the leading edge of a media sheet along one or more of the module media paths A, B, C. In particular, when pivoted to rest against media guide surface 206, the first movable diverter 204 permits a media sheet exiting the imager 108 to travel along module media path A, referred to as the default module media path, to the second roller pair 216. When the first movable diverter 204 is pivoted to rest against media guide surface 210, the first movable diverter 204 directs a media sheet exiting the imager 108 along module media path B, referred to as the second segment of the diverter-directed module media path. Likewise, when the second movable diverter 208 is pivoted to rest against media guide surface 244 of the cover 220, the second movable diverter 208 directs a media sheet traveling along module media path B to the first roller pair 212. However, when the second movable diverter 208 is pivoted to rest against media guide surface 206, the second movable diverter 208 directs a media sheet transported in reverse by the first roller pair 212 along module media path C, referred to as the first segment of the diverter-directed module media path.

The diverter actuation system pivots the first and second movable diverters 204, 208 selectively in order to route a media sheet along one or more of the module media paths A, B, C. The diverter actuation system includes at least one actuator (not illustrated) configured to pivot the movable diverters 204, 208. The at least one actuator may be coupled to either the module frame 200 or the media guide unit 268. In one embodiment, a first actuator is connected to the media guide unit 268 and is configured to pivot the first movable diverter 204, and a second actuator is connected to the media guide unit 268 and is configured to pivot the second movable diverter 208.

The actuators may be provided as any device capable of providing linear or rotational motion suitable to pivot the first and second movable diverters 204, 208. In particular, the first and second actuators may be solenoids connected to levers extending from the pivot rods 224, 228. The linear motion of the solenoids pushes and/or pulls on the levers, which rotates the pivots rods 224, 228 and the diverters 204, 208. Alternatively, the first and second actuators may be first and second electric motors having output shafts mechanically coupled to the pivot rods 224, 228. Rotation of the electric motors rotates the pivot rods 224, 228, which causes the diverters 204, 208 to rotate. Any actuator capable of providing linear or rotational motion may be configured to pivot the first and second movable gates 204, 208. Additionally, springs may be employed to return the diverters 204, 208 to a default position regardless of the actuation means.

The integrated module 112 may include dampeners 232, 234, 236, as illustrated in FIG. 2, to cushion the impact of the movable diverters 204, 208 against the media guide surfaces. The diverters 204, 208 may abruptly come to a stop against the media guide surfaces, because the actuators may pivot the movable diverters 204, 208 very quickly. Thus, to eliminate the potential for undesirable noise, the integrated module 112 may include dampeners 232, 234, 236. The dampeners 232, 234, 236 should be formed of a resilient material that attenuates noise and vibration. Suitable materials include, but are not limited to, rubber, silicone, or other elastomeric materials. A dampener 232, 234, 236 may be connected to the media guide surfaces at each intersection of the movable diverters 204, 208 and the media guide surfaces. The dampeners 232, 234, 236 do not interfere with the movement of media sheets through the module 112. In the example described, the dampeners 232, 234, 236 act as soft bumpers. Dampening may instead or additionally be accomplished with a viscous element which slows the motion of a diverter 204, 208 when actuated.

The cover 220 is movably connected to the module frame 200. When the cover 220 is opened the module media paths A, B, and C are exposed to enable viewing of the default module media path and the diverter-directed module media path. When the cover 220 is closed the underside of the cover 220 forms a media guide surface of module media path C. The cover 220 includes a pivotable hinge 240, a media guide surface 244, a viewing window 248, a latch 252, an alignment post 256, a biasing member 260, and, in some embodiments, at least two media sheet sensors 262, 264.

Figure 3:
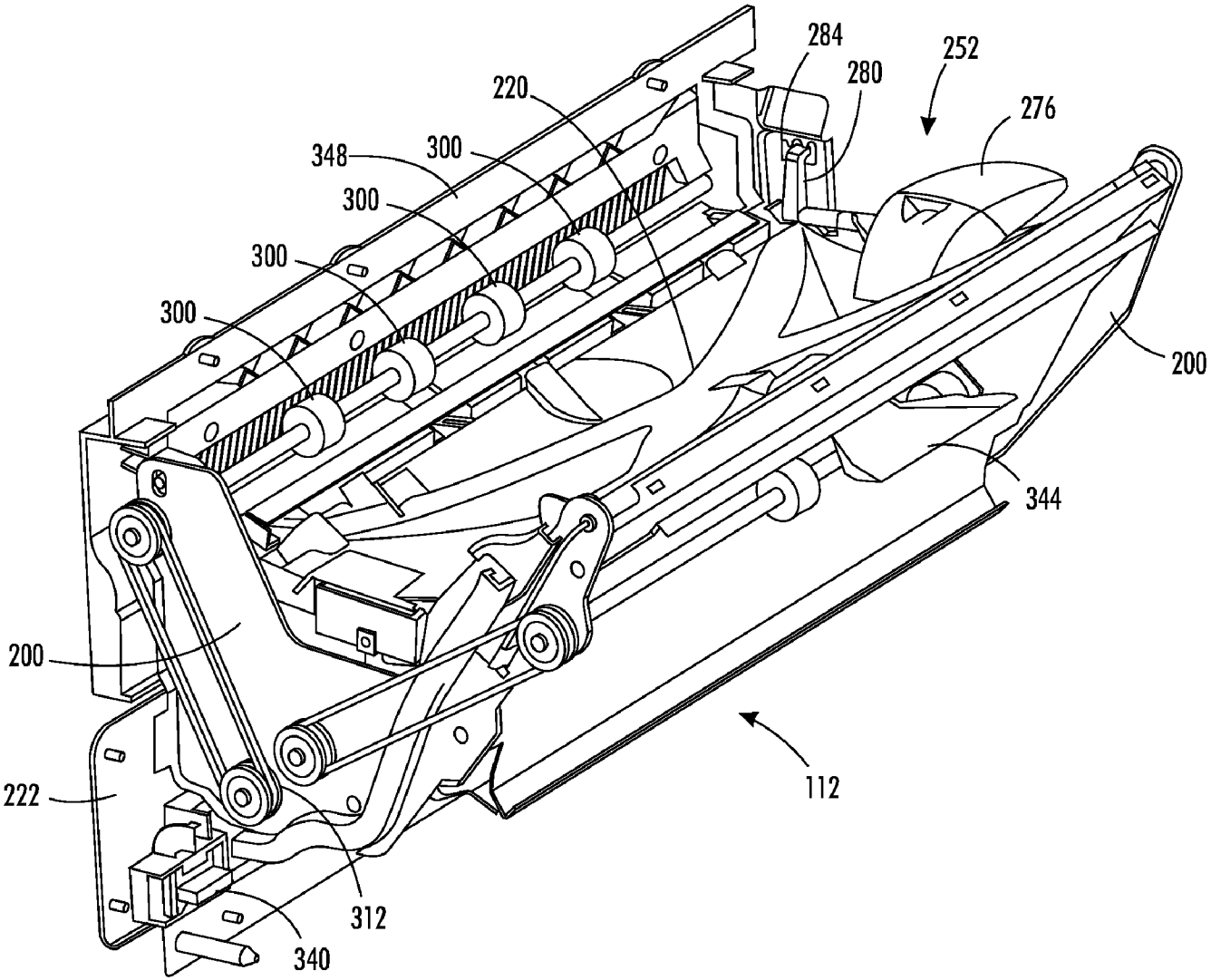
FIG. 3 depicts a perspective view of the integrated module depicted in FIG. 2.
Figure 4:
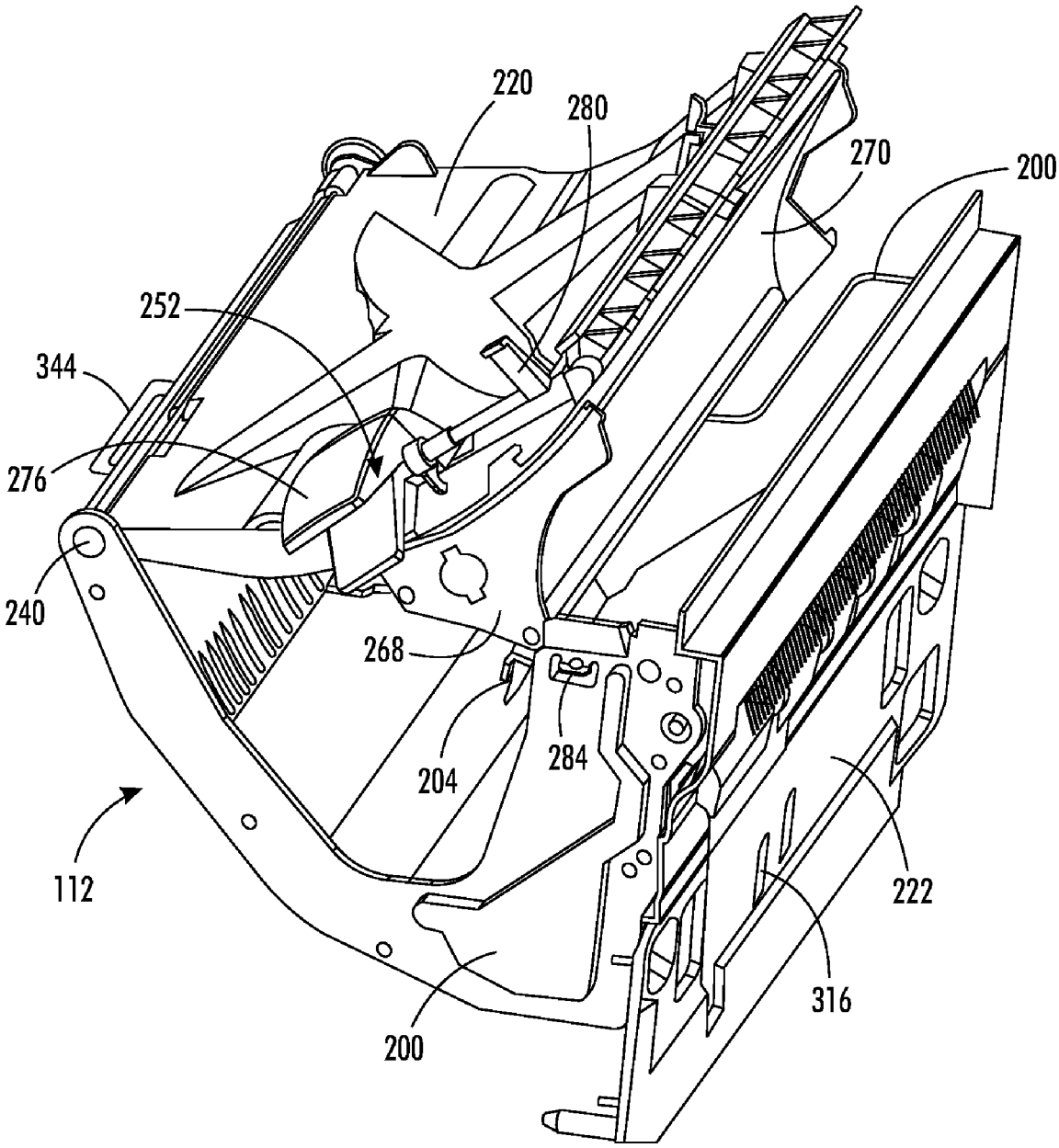
FIG. 4 depicts a perspective view of the integrated module depicted in FIG. 2.

The pivotable hinge 240 rotatably secures the cover 220 to the module frame 200. Specifically, the pivotable hinge 240 includes two brackets that engage a shaft or shafts secured to the module frame 200. When the brackets are engaged with the shaft or shafts, the cover 220 may be rotated about the pivotable hinge 240 between a closed position, as illustrated in FIG. 2 and FIG. 3, and a partially open position as illustrated in FIG. 4. The cover 220 does not require a connection to the printer frame 102, thereby maintaining the integrated design of the module 112.

Media guide surface 244 includes the portion of the cover 220 forming the upper boundary of module media path C, referred to as the first segment of the diverter-directed module media path. The media guide surface 244 is generally free from surface irregularities; however, the guide surface 244 may include an opening for the viewing window 248 and a connection point for the idler roller 288 of the first roller pair 212. Media sheets that contact the guide surface 244 do not become jammed or otherwise impeded; instead, the guide surface 244 smoothly directs the media sheets along module media path C.

In one embodiment, the media guide surface 244 may include at least one opening (not illustrated) aligned with a single edge diverter 204, 208 or, if so configured, a plurality of "fingers" formed upon the second movable diverter 208. The openings permit a portion of the second movable diverter 208 to extend within the cover 220, above the at least one opening in the media guide surface 244. The junction of the diverter 208 and the media guide surface 244 is thus free from protrusions or irregularities that might jam or catch the edge of a media sheet as the media sheet translates and/or rotates along module media path B. The openings in the media guide surface 244 may be a relief inset into the media guide surface 244. The one or more portions of the diverter 208 extending through the openings may be referred to as a region. The region may be a portion, a substantial width or the full width of a portion of the diverter 208 length extending from the tip of a continuous blade or one or more fingers of a discontinuous blade. A continuous blade may have an arcuate or otherwise nonlinear tip configuration so that only a portion of its width would extend into a relief or opening.

In one embodiment, the media guide unit 268 may be connected to the cover assembly 220 to form module media path C. In particular, the media guide unit 268 may be connected to the cover assembly 220 with media guide surface 272 located a predetermined distance away from media guide surface 244. The predetermined distance establishes the height of module media path C. In this embodiment, when the cover 220 is pivoted to the open position, the media guide unit 268 and the movable diverters 204, 208 are withdrawn from an interior region of the integrated module 112, as shown best in FIG. 4. Accordingly, in the open position, media guide surfaces 206 and 210 are exposed allowing for a visual inspection of module media paths A, B, and C.

In yet another embodiment, the media guide unit 268 may be removably connected to the cover assembly 220. Specifically, when the cover 220 is in the open position, the media guide unit 268, along with the movable diverters 204, 208 may be detached from the cover 220. The media guide unit 268 may then be attached to the cover 220 when operation of the printer 100 is required. When the cover 220 is in the open position and the media guide unit 268 is detached from the cover 220, the entirety of each module media path A, B, C is visible allowing for inspection of the media paths A, B, C.

The viewing window 248 of the cover assemble 220 is an opening extending through the cover assembly 220 that permits a user to view at least the diverter-directed module media path. The viewing window 248 may be defined by an opening having a circular, rectangular, or any other closed shape having straight or curved edges. Additionally, the viewing window 248 may include a protective cover to prevent objects from falling through the viewing window 248 and obstructing the module media paths A, B, C.

The latch member 252 of the cover assembly 220, as best seen in FIG. 3 and FIG. 4, secures the cover 220 in a closed position. The latch member 252 includes a handle 278 and a tab 280. The handle 278, as illustrated in FIG. 3 and FIG. 4, is rotatably secured to the cover 220 to pivot between a locked and an unlocked position. Likewise, the tab 280, as shown in FIG. 4, may be configured to pivot or rotate when the handle 278 is pivoted. When the cover 220 is in the closed position the handle 278 may be pivoted to the locked position, which causes the tab 280 to engage an opening 284 (shown in FIG. 4) in the frame 200 of the integrated module 112, thereby securing the cover 220 in the closed position. To open the cover 220, the handle 278 may be pivoted to the unlocked position. This motion pivots the tab 280 out of the opening 284 and permits the cover 220 to be rotated to the open position. In some embodiments, the handle 278 may be removed from the integrated module 112 after the module 112 has been installed upon the printer frame 102 and the cover 220 has been secured in the closed position. The handle 278 may then be attached to the module 112 to unlock and open the cover 220.

The cover 220 may include a biasing member 260 to bias the cover 220 toward the open position. The biasing member 260 is interposed between the cover 220 and the module frame 200 near the pivotable hinge 240. The biasing member 260 may be a torsion spring that generates a torque as the cover 220 is pivoted to the closed position. The torque generated by the torsion spring biases the cover 220 toward the open position. Other biasing members 260 capable of generating a force sufficient to bias the cover 220 toward the open position may also be utilized. In particular, if the integrated module 112 were oriented in a printer 100 other than as suggested by the figures, a biasing member 260 may not be needed or may apply a counterbalancing force in the opposite direction.

The media sheet sensors 262, 264 of the cover assembly 220 detect the presence of a media sheet proximate the roller pairs 212, 216 of the integrated module 112. As illustrated in FIG. 2, a first sensor 262 may be connected to the cover 220 to detect the presence of a media sheet proximate to the first roller pair 212, and a second sensor 264 may be connected to the cover 220 to detect the presence of a media sheet proximate to the second roller pair 216. Various types of sensors 262, 264 may be utilized to detect media sheets, including semiconductor photodetectors or mechanical position sensors. Alternatively, the sensors 262, 264 may be connected to the module frame 200 in a position suitable to detect the presence of media sheets proximate the first and second roller pairs 212, 216. Furthermore, the module 112 may also include a sensor to detect the presence of media sheets near the first movable diverter 204.

The first and second roller pairs 212, 216 of the integrated module 112 transport media sheets. The roller pairs 212, 216 each include an idler roller 288, 292, a drive roller 296, 300, and a biasing member 304, 308. The drive rollers 296, 300 are rotatably connected to the frame 200 of the integrated module 112, having longitudinal axes oriented perpendicularly to the direction a media sheet travels on the module media paths A, B, C. Specifically, the drive roller 296 of the first roller pair 212 is connected to the module frame 200 at the end of module media path B and the beginning of module media path C. The drive roller 300 of the second roller pair 216 is connected to the module frame 200 at the end of module media paths A and C. The roller pairs 212, 216 do not require a connection to any portion of the printer frame 102; instead, each element of the roller pairs 212, 216 is connected to the integrated module 112 directly. Furthermore, in some embodiments, the drive rollers 296, 300 may be segmented cylinders separated by a gap or gaps, instead of cylinders having a length that extends across the width of the module media paths A, B, C.

The idler rollers 288, 292 of each roller pair 212, 216 have longitudinal axes mounted parallel to the drive rollers 296, 300. The idler rollers 288, 292 contact the drive rollers 296, 300 and rotate in response to the rotation of the drive rollers 296, 300. Additionally, the idler rollers 288, 292 translate at least somewhat perpendicularly to an axis rotation of the idler rollers 288, 292 to compensate for the thickness of a media sheet in the roller pairs 212, 216. For instance, to compensate for the thickness of a media sheet in the first roller pair 212, idler roller 288 may be displaced further into the cover assembly 220. Similarly, idler roller 292 compensates for the thickness of a media sheet by translating downward, away from drive roller 300. After a media sheet exits a roller pair 212, 216 the biasing members 304, 308 force the idler rollers 288, 292 back into contact with drive rollers 296, 300. Furthermore, in some embodiments, the idler rollers 288, 292 may be segmented cylinders separated by a gap or gaps, instead of cylinders having a length that extends across the width of the module media paths A, B, C.

The biasing members 304, 308 of the roller pairs 212, 216 urge the idler rollers 288, 292 toward the drive rollers 296, 300. The biasing force ensures the roller pairs 212, 216 transport media sheets without slipping or marking the media sheets. The biasing members 304, 308 may be torsion springs mounted on each end of each idler roller 288, 292, to provide a uniform nip load to the roller pairs 212, 216. However, any biasing member 304, 308 may be utilized that sufficiently urges the idler rollers 288, 292 toward the drive rollers 296, 300 and permits the position of the idler rollers 288, 292 to adjust depending on the thickness of the media sheets in the roller pairs 212, 216.

Each drive roller 296, 300 is coupled to a source of rotation. The source of rotation may be a single stepper motor configured to rotate both driver rollers 296, 300 precisely. The rotation provided by the stepper motor may be coupled to the drive rollers 296, 300 with a pulley and belt transmission system 312, as illustrated in FIG. 3. Rotation of the stepper motor causes the pulley or pulleys to rotate, and the belts transfer the rotation to the drive rollers 296, 300 of each roller pair 212, 216. In some embodiments, the pulleys may have cogs or teeth if the belt is a timing belt. Furthermore, if the integrated module 112 utilizes only one stepper motor, both roller pairs 212, 216 may rotate simultaneously. Alternatively, some embodiments of the integrated module 112 may utilize two stepper motors, to enable each roller pair 212, 216 to be precisely controlled independently. Additionally, one or more direct current ("DC") electric motors and/or clutches may be utilized to rotate the drive rollers 296, 300.

In one embodiment, the source of rotation of the rollers pairs 212, 216, as well as the transmission system 312, may be assembled, configured, and tested upon the integrated module 112 apart from the printer 100 and the printer frame 102. However, in another embodiment, an element or elements of the source of rotation of the roller pairs 212, 216 may reside outboard of module 112. The element or elements located outboard of the module 112 may be configured to engage or interface with the module 112 when the module 112 is installed in the printer 100. In particular, gears or other engagement features may allow motors to reside outboard of the module 112 in such a way as to engage when the module 112 is installed. Testing of the module 112 may be accomplished with a complementarily equipped test station having the element or elements located outboard of the integrated module 112.

The connecting plate 222 of the integrated module 112 is coupled to the module frame 200. The connecting plate 222 may be made from any rigid material including, but not limited to, sheet metal, carbon fiber, or aluminum. As illustrated in FIG. 4, the connecting plate 222 includes attachment points 316 that secure a printer device to the integrated module 112. The attachment points 316 may be openings or protrusions designed to couple a finisher 116 or other printer device to the integrated module 112. The connecting plate 222 may support a finisher 116 or other printer device without requiring the finisher 116 or other printer device to be connected to the printer frame 102. In particular, when a printer device is secured to the connecting plate 222 a device media path of the printer device may be aligned with one or more module media paths A, B, C.

The integrated module 112 may also include a corrugation roller 320 to corrugate media sheets exiting the roller pair 216. As illustrated in FIG. 2, the corrugation roller 320 temporarily deforms media sheet exiting the second roller pair 216 in order to increase temporarily the beam strength of the media sheets. The corrugation roller 320 includes a pivotable lever 322, a biasing member 328, and a corrugation wheel 332. The pivotable lever 322 is connected to the module frame 200 at pivot point 336. The corrugation wheel 332 is connected to a second end of the pivotable lever 322 and is mounted for rotation. Each element of the corrugation roller 320 is coupled to the module 112, thus the corrugation roller 320 maintains the integral structure of the module 112.

The corrugation wheel 332 contacts and deforms a media sheet as the media sheet exits the second roller pair 216. The corrugation wheel 332 is positioned between two segments of the idler roller 292 and the drive roller 300. The biasing member 328 maintains the corrugation wheel 332 above the point at which the drive roller 300 contacts the idler roller 292. The deformation provided by the corrugation wheel 332 increases the beam strength of the media sheets, which may permit the media sheets to travel more quickly along a device media path or a finisher media path. The increased beam strength may also allow media sheets to fall from the integrated module 112 into an even stack when an output media tray 120 is coupled to the integrated module 112.

As illustrated in FIG. 3, the integrated module 112 includes one or more electrical connectors 340 through which each signal wire that requires a connection to the printer 100 is coupled. The module 112 may utilize a single electrical connector 340, as illustrated FIG. 3, or a plurality of electrical connectors 340. For instance, each electrical signal wire utilized by the integrated module 112 may be coupled to the electrical connector 340. Alternatively, the control signal wires may be separated from power and ground wires. The electrical connector 340 may include a short length of flexible signal wire to enable the connector 340 to extend away from the module 112 to couple with a corresponding electrical connector on the printer frame 102. Multiple connectors 340 may be used for signal and/or power wires.

The integrated module 112 may also include a media sheet barrier 344. The media sheet barrier 344 is coupled to the integrated module 112 at the end of module media path B. The media sheet barrier 344 prevents media sheets from entering a region between the module frame 200 and the printer frame 102. In particular, the media sheet barrier 344 prevents media sheets from falling between the output of the first roller pair 212 and the input of the imager 108. Materials suitable to form the media sheet barrier 344 include, but are not limited to, metal, plastic, or any other rigid material.

The integrated module 112 may also include a one-way bearing 348 connected to the module frame 200 near the second roller pair 216. The one-way bearing 348 permits a media sheet to enter the second roller pair 216 from only one direction. Specifically, a media sheet may only enter the second roller pair 216 when traveling toward the second roller pair 216 on module media paths A or C. Stated differently, the one-way bearing 348 prevents a media sheet exiting the second roller pair 216 from remaining in contact with the rollers 292, 300 and being drawn above the drive roller 300 into the second roller pair 216.

Additionally, the integrated module 112 includes an electrostatic charge reducing device 352 configured to reduce the electrostatic charge on a media sheet. Some imagers 108 introduce a strong electrostatic charge upon the media sheets during the imaging process. The electrostatic charge may make media sheets exiting the module 112 difficult for a finisher 116 or other printer device to handle. Furthermore, the electrostatic charge may prevent the media sheets from forming a stack properly after processing by either the finisher 116 or the integrated module 112. Thus, to reduce the electrostatic charge upon media sheets exiting the integrated module 112, the module 112 includes an electrostatic charge reducing device 352 that contacts media sheets as they exit the second roller pair 216. The electrostatic charge reducing device 352 may be formed of a plurality of fibers each having a resistance of approximately of $2*10^3$ ohms/centimeter. Although illustrated near the second roller pair 216, the electrostatic charge reducing device 352 may be located at any point within the integrated module 112 in which the reduction of electrostatic charge is desired. For instance, the integrated module 112 may include an electrostatic charge reducing device 352 that contacts media sheets as they exit the first roller pair 212.

Each or any combination of the above described printer subsystem components may be coupled to the module frame 200 to form the integrated module 112. Specifically, each subsystem component may be coupled or connected to the module frame 200 before the module 112 is inserted into the predetermined space in the printer 100. The integrated module 112 simplifies the assembly of a printer 100 by permitting each component of the integrated module 112 to be connected to the module frame 200 at an appropriate position to perform its intended function before the integrated module 112 is connected to the printer 100. Furthermore, the integrated module 112 may be tested for proper operation without connecting the module frame 200 to the printer frame 102.

An exemplary testing sequence may include coupling the electronic connector or connectors 340 to a corresponding electronic connector or connectors of a test apparatus. The test apparatus may generate test signals that actuate or stimulate each electronic component of the integrated module 112. If a particular component does not function properly it may be reconfigured, repaired, or aligned before connecting the module 112 to the printer 100. When the integrated module 112 has been assembled and tested completely, it may be positioned within the predetermined space and connected to the printer frame 102.

In one mode of operation, the integrated module 112 routes media sheets received from the imager 108 directly through the second roller pair 216 and into an output tray 120 or finisher 116 coupled to the connecting plate 222. In particular, to route a media sheet directly through the second roller pair 216, the actuator rotates the first movable diverter 204 until the diverter 204 has rested against media guide surface 206. The smooth surface of diverter 204 guides a media sheet received from the imager 108 along module media path A toward the first roller pair 212. Upon reaching the first roller pair 212, the media sheet is propelled toward the output tray 120, finisher 116, or another printer device connected to the connecting plate 222. Furthermore, as the media sheet passes through the first roller pair 212 it may be corrugated by the corrugation roller 320. Additionally, the media sheet may pass, but not necessarily contact, the electrostatic charge reducing device 352, which reduces the electrostatic charge upon the media sheet and prepares the media sheet for entry into the finisher 116, the output media tray 120, or another printer device. Additionally, the one-way bearing 348 prevents the media sheet from becoming drawn into the second roller pair 216 after exiting the module 112.

The integrated module 112 may also route a media sheet received from the imager 108 back to the imager 108 for dual-sided printing. To route a media sheet back to the imager 108, the module 112 energizes the actuators, which pivots the first movable diverter 204 against media guide surface 210 and pivots the second movable diverter 208 against the media guide surface 244. A portion or portions of diverter 208 may enter the openings in media guide surface 244 when pivoted by the actuator. In this configuration, diverter 204 guides a media sheet coming from the imager 108 along module media path B. Upon reaching the second roller pair 212 the media sheet is propelled toward the second entry point of the imager 108, or another printer device that may be coupled to the printer frame 102 at the output of roller pair 212.

Additionally, the integrated module 112 may invert or flip a media sheet before routing a media sheet to a printer device connected to the connecting plate 222. To invert a media sheet, the module 112 pivots the first movable diverter 204 until the diverter 204 has rested against media guide surface 210 and pivots the second movable diverter 208 against the media guide surface 244. In this configuration, diverter 204 guides a media sheet along module media path B and diverter 208 guides the media sheet to roller pair 212. Before the media sheet completely exits roller pair 212, the rollers 288, 296 stop rotating, and diverter 208 is pivoted against media guide surface 206. Next, the rollers 288, 296 start rotating in the opposite direction, which transports the media sheet along module media path C toward the second roller pair 216. The media sheet enters the second roller pair 216 in an inverted or flipped configuration as compared to the configuration of the media sheet if it were to enter the second roller pair 216 after traveling along module media path A. Thus, the integrated module 112 may deliver a media sheet to the second roller pair 216 with either side of the media sheet facing in the upward direction.

The cover 220 should remain in the closed position when the printer 100 is operating. When the cover 220 is in the closed position the media guide surface 244 forms the upper boundary of module media path C. The observational window 248 of the cover 220 permits a user to inspect a portion of module media path C to ensure that media sheets are traveling properly along the path C. If media sheets are not traveling properly along module media path C, sensors 262 and 264 may detect the problem and signal to an electronic controller that the module media paths A, B, C should be inspected.

In the open position, the cover 220 exposes the internal structure of the integrated module 112. To open the cover 220 a user grasps and rotates the handle 278, which releases the tab 280 from the tab opening 284. As the cover 220 is opened, the media guide unit 268 and the movable diverters 204, 208 are removed from the interior region of the integrated module 112. A user may view and inspect the integrated module 112 for problems or faults when the cover 220 is in the open position. Note that the second movable diverter 208 may be manually rotated to expose the entirety of module media path C. Additionally, in some embodiments, the media guide unit 268 may be removed from the open cover 220 to fully expose each module media path A, B, C. Accordingly, in each embodiment, faults within the integrated module 112 may be easily identified without having to remove the module 112 from the printer frame 102. A movable diverter 204, 208 has been extensively described but as earlier stated, the gates or diverters may take many forms. The diverters 204, 208 may be positioned or actuated by a driven mechanism, may be stationary, passive, manually moved, position altered based on cover 220 or panel position or as a consequence of the position or presence of options.

In the event that a problem or fault with the integrated module 112 cannot be repaired quickly, the entire faulty integrated module 112 may be removed from the printer frame 102 and replaced with another functional integrated module 112. The integrated structure of the module 112 ensures that once the module 112 is secured to the printer frame 102, it is ready to operate without requiring the alignment or calibration of any module 112 components with other printer 100 components.

In another embodiment, the integrated module 112 may receive a media sheet from a printer 100 component other than an imager 108. Specifically, the integrated module 112 may be positioned at any point in the printer media path which requires the selective guidance of media sheets between two different module media paths. For example, the integrated module 112 may receive media sheets directly from the input media tray 104. Likewise, the module 112 may receive output from a first finisher 116 and redirect it to the input of second finisher (not illustrated) or to a second media output tray (not illustrated).

The described and illustrated assembly is one example of how various elements and functions can be integrated into a single integrated module. It will be appreciated that variations of the above-disclosed module and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Furthermore, although a monochrome printing apparatus has been described in the specification, the claims can encompass embodiments that print in color or handle color image data.

The invention claimed is:

1. An integrated module for installation within a printer comprising:

a module frame configured to fit within a predetermined space within a printer and to connect to a printer frame positioned about the predetermined space;

a plurality of a printer subsystem components configured to mount to the module frame, at least one printer subsystem component having a default module media path and at least one diverter-directed module media path within the printer subsystem component, the at least one printer subsystem component being configured to connect to the module frame at a position that enables the default module media path and the at least one diverter-directed module media path to complete a printer media path through the predetermined space when the module frame having the printer subsystem component is connected to the printer frame;

a cover assembly having a media guide surface and a latch member, the cover assembly pivotally secured to the module frame to pivot between a first position in which the media guide surface forms a boundary of a first segment of the at least one diverter-directed module media path and a second position in which the cover assembly exposes the at least one diverter-directed module media path and the default module media path, the latch member is configured to secure the cover assembly in the first position selectively;

a first roller pair having a first roller, a second roller, and a biasing member, the first roller coupled to a first actuator configured to rotate the first roller, the second roller secured to the cover assembly and mounted parallel to the first roller, and the biasing member configured to urge the second roller toward the first roller;

a second roller pair having a first roller, a second roller, and a biasing member, the first roller of the second roller pair coupled to a second actuator configured to rotate the first roller of the second roller pair, the second roller of the second roller pair secured to the module frame and mounted parallel to the first roller of the second roller pair, and the biasing member of the second roller pair configured to urge the second roller of the second roller pair toward the first roller of the second roller pair;

a first sensor configured to detect the presence of a media sheet proximate the first roller pair; and a second sensor configured to detect the presence of a media sheet proximate the second roller pair.

2. The integrated module of claim 1, the plurality of printer subsystem components comprising:

a connecting plate configured to secure a printer device to the module frame removably, the printer device having at least one device media path configured to be aligned with the default module media path and the at least one diverter-directed module media path when the printer device is secured to the connecting plate;

at least one electrical connector assembly for terminating a plurality of electrical signal conductors, the electrical connector assembly configured to connect a plurality of electrical conductors utilized by the integrated module to the printer; and at least one electrostatic charge reducing device configured to reduce the electrostatic charge on a media sheet.

3. An integrated module for installation within a printer comprising:

a module frame configured to fit within a predetermined space within a printer and to connect to a printer frame positioned about the predetermined space;

a plurality of a printer subsystem components configured to mount to the module frame, at least one printer subsystem component having a default module media path and at least one diverter-directed module media path within the printer subsystem component, the at least one printer subsystem component being configured to connect to the module frame at a position that enables the default module media path and the at least one diverter-directed module media path to complete a printer media path through the predetermined space when the module frame having the printer subsystem component is connected to the printer frame;

a cover assembly having a media guide surface and a latch member, the cover assembly pivotally secured to the module frame to pivot between a first position in which the media guide surface forms a boundary of a first segment of the at least one diverter-directed module media path and a second position in which the cover assembly exposes the at least one diverter-directed module media path and the default module media path, the latch member is configured to secure the cover assembly in the first position selectively;

a media guide unit connected to one of the module frame and the cover assembly, the media guide unit having a plurality of media guiding surfaces, at least one of the media guiding surfaces forming the first segment of the at least one diverter-directed module media path with the media guide surface of the cover assembly;

at least one movable diverter pivotally connected to one of the module frame and the media guide unit, the at least one movable diverter configured to direct a media sheet to a second segment of the diverter-directed module media path when in a first position and to direct a media sheet to one of the first segment of the diverter-directed module media path and the default module media path when in a second position;

a diverter actuation system connected to one of the module frame and the media guide unit, the diverter actuation system configured to pivot the at least one movable diverter between the first position and the second position selectively; and at least one dampener configured to cushion the at least one movable diverter as the diverter actuation system pivots the at least one movable diverter between the first position and the second position.

4. An integrated module for installation within a printer comprising:

a module frame configured to fit within a predetermined space within a printer and to connect to a printer frame positioned about the predetermined space;

a plurality of a printer subsystem components configured to mount to the module frame, at least one printer subsystem component having a default module media path and at least one diverter-directed module media path within the printer subsystem component, the at least one printer subsystem component being configured to connect to the module frame at a position that enables the default module media path and the at least one diverter-directed module media path to complete a printer media path through the predetermined space when the module frame having the printer subsystem component is connected to the printer frame;

a cover assembly having a media guide surface and a latch member, the cover assembly pivotally secured to the module frame to pivot between a first position in which the media guide surface forms a boundary of a first segment of the at least one diverter-directed module media path and a second position in which the cover assembly exposes the at least one diverter-directed module media path and the default module media path, the latch member is configured to secure the cover assembly in the first position selectively;

a media guide unit connected to the cover assembly, the media guide unit having a plurality of media guiding surfaces, at least one of the media guiding surfaces forming the first segment of the at least one diverter-directed module media path with the media guide surface of the cover assembly;

at least one movable diverter pivotally connected to one of the module frame and the media guide unit, the at least one movable diverter configured to direct a media sheet to a second segment of the diverter-directed module media path when in a first position and to direct a media sheet to one of the first segment of the diverter-directed module media path and the default module media path when in a second position;

a diverter actuation system connected to one of the module frame and the media guide unit, the diverter actuation system configured to pivot the at least one movable diverter between the first position and the second position selectively; and the media guide unit is configured to remain connected to the cover assembly as the cover assembly is pivoted to the second position to enable viewing of the default module media path and the at least one diverter-directed module media path.

5. A printer for fixing an image upon a media sheet comprising:

an imaging apparatus mounted to the printer frame, the imaging apparatus configured to fix an image to a media sheet and to transport the media sheet along one or more printer media paths;

a predetermined space defined by a printer frame;

an integrated module having a module frame configured to fit within the predetermined space and to connect to the printer frame within the predetermined space;

a plurality of a printer subsystem components configured to mount to the module frame, at least one printer subsystem component having a default module media path and at least one diverter-directed module media path within the printer subsystem component, the at least one printer subsystem component being configured to connect to the module frame at a position that enables the default module media path and the at least one diverter-directed module media path to complete a printer media path through the predetermined space when the module frame having the printer subsystem component is connected to the printer frame;

a cover assembly having a media guide surface and a latch member, the cover assembly pivotally secured to the module frame to pivot between a first position in which the media guide surface forms a boundary of a first segment of the at least one diverter-directed module media path and a second position in which the cover assembly exposes the at least one diverter-directed module media path and the default module media path, the latch member is configured to secure the cover assembly in the first position selectively;

a media guide unit connected to one of the module frame and the cover assembly, the media guide unit having a plurality of media guiding surfaces, at least one of the media guiding surfaces forming the first segment of the at least one diverter-directed module media path with the media guide surface of the cover assembly;

at least one movable diverter pivotally connected to one of the module frame and the media guide unit, the at least one movable diverter configured to direct a media sheet to a second segment of the diverter-directed module media path when in a first position and to direct a media sheet to one of the first segment of the diverter-directed module media path and the default module media path when in a second position;

a diverter actuation system connected to one of the module frame and the media guide unit, the diverter actuation system configured to pivot the at least one movable diverter between the first position and the second position selectively; and the media guide unit is configured to remain connected to the cover assembly as the cover assembly is pivoted to the second position to enable viewing of the default module media path and the at least one diverter-directed module media path.

6. The printer of claim 5, the plurality of printer subsystem components comprising:

a connecting plate configured to secure a printer device to the module frame removably, the printer device having at least one device media path configured to be aligned with the default module media path and the at least one diverter-directed module media path when the printer device is secured to the connecting plate;

at least one electrical connector assembly for terminating a plurality of electrical signal conductors, the electrical connector assembly configured to connect a plurality of electrical conductors utilized by the integrated module to the printer; and at least one electrostatic charge reducing device configured to reduce the electrostatic charge on a media sheet.

7. A printer for fixing an image upon a media sheet comprising:

an imaging apparatus mounted to the printer frame, the imaging apparatus configured to fix an image to a media sheet and to transport the media sheet along one or more printer media paths;

a predetermined space defined by a printer frame;

an integrated module having a module frame configured to fit within the predetermined space and to connect to the printer frame within the predetermined space;

a plurality of a printer subsystem components configured to mount to the module frame, at least one printer subsystem component having a default module media path and at least one diverter-directed module media path within the printer subsystem component, the at least one printer subsystem component being configured to connect to the module frame at a position that enables the default module media path and the at least one diverter-directed module media path to complete a printer media path through the predetermined space when the module frame having the printer subsystem component is connected to the printer frame;

a cover assembly having a media guide surface and a latch member, the cover assembly pivotally secured to the module frame to pivot between a first position in which the media guide surface forms a boundary of a first segment of the at least one diverter-directed module media path and a second position in which the cover assembly exposes the at least one diverter-directed module media path and the default module media path, the latch member is configured to secure the cover assembly in the first position selectively;

a first roller pair having a first roller, a second roller, and a biasing member, the first roller coupled to a first actuator configured to rotate the first roller, the second roller secured to the cover assembly and mounted parallel to the first roller, and the biasing member configured to urge the second roller toward the first roller;

a second roller pair having a first roller, a second roller, and a biasing member, the first roller of the second roller pair coupled to a second actuator configured to rotate the first roller of the second roller pair, the second roller of the second roller pair secured to the module frame and mounted parallel to the first roller of the second roller pair, and the biasing member of the second roller pair configured to urge the second roller of the second roller pair toward the first roller of the second roller pair;

a first sensor configured to detect the presence of a media sheet proximate the first roller pair; and a second sensor configured to detect the presence of a media sheet proximate the second roller pair.

8. A printer for fixing an image upon a media sheet comprising:

an imaging apparatus mounted to the printer frame, the imaging apparatus configured to fix an image to a media sheet and to transport the media sheet along one or more printer media paths;

a predetermined space defined by a printer frame;

an integrated module having a module frame configured to fit within the predetermined space and to connect to the printer frame within the predetermined space;

a plurality of a printer subsystem components configured to mount to the module frame, at least one printer subsystem component having a default module media path and at least one diverter-directed module media path within the printer subsystem component, the at least one printer subsystem component being configured to connect to the module frame at a position that enables the default module media path and the at least one diverter-directed module media path to complete a printer media path through the predetermined space when the module frame having the printer subsystem component is connected to the printer frame;

a cover assembly having a media guide surface and a latch member, the cover assembly pivotally secured to the module frame to pivot between a first position in which the media guide surface forms a boundary of a first segment of the at least one diverter-directed module media path and a second position in which the cover assembly exposes the at least one diverter-directed module media path and the default module media path, the latch member is configured to secure the cover assembly in the first position selectively;

a media guide unit connected to one of the module frame and the cover assembly, the media guide unit having a plurality of media guiding surfaces, at least one of the media guiding surfaces forming the first segment of the at least one diverter-directed module media path with the media guide surface of the cover assembly;

at least one movable diverter pivotally connected to one of the module frame and the media guide unit, the at least one movable diverter configured to direct a media sheet to a second segment of the diverter-directed module media path when in a first position and to direct a media sheet to one of the first segment of the diverter-directed module media path and the default module media path when in a second position;

a diverter actuation system connected to one of the module frame and the media guide unit, the diverter actuation system configured to pivot the at least one movable diverter between the first position and the second position selectively;

at least one electrical connector assembly for terminating a plurality of electrical signal conductors, the electrical connector assembly configured to connect a plurality of electrical conductors utilized by the integrated module to the printer;

an electrostatic charge reducing device configured to reduce the build up of electrostatic charge on a media sheet; and at least one dampener configured to cushion the at least one movable diverter as the diverter actuation system pivots the at least one movable diverter between the first position and the second position.

9. A method of integrating printer subsystem components:

connecting a plurality of printer subsystem components to a frame of an integrated module, at least one printer subsystem component defining a default module media path and at least one diverter-directed module media path, the connecting of the printer subsystem components to the frame including:

connecting a cover assembly to the frame of the integrated module, the cover assembly having a media guide surface and a latch member, the cover assembly pivotally secured to the module frame to pivot between a first position in which the media guide surface forms a boundary of a first segment of the at least one diverter-directed module media path and a second position in which the cover assembly exposes the at least one diverter-directed module media path and the default module media path, the latch member is configured to secure the cover assembly in the first position selectively;

removably connecting a media guide unit to one of the cover assembly and the module frame, the media guide unit connected to one of the module frame and the cover assembly, the media guide unit having a plurality of media guiding surfaces, at least one of the media guiding surfaces forming the first segment of the at least one diverter-directed module media path with the media guide surface of the cover assembly;

connecting at least one movable diverter to one of the module frame and the media guide unit, the at least one movable diverter configured to direct a media sheet to a second segment of the diverter-directed module media path when in a first position and to direct a media sheet to one of the first segment of the diverter-directed module media path and the default module media path when in a second position;

connecting a diverter actuation system to one of the module frame and the media guide unit, the diverter actuation system configured to pivot the at least one movable diverter between the first position and the second position selectively;

positioning the plurality of printer subsystem components connected to the integrated module within a printer by connecting the frame of the integrated module as a single unit to a predetermined space defined by a frame of the printer;

completing a printer media path through the predetermined space with the default module media path and the at least one diverter-directed module media path when the module frame having the at least one printer subsystem component is connected to the printer frame; and pivoting the cover assembly to the second position with the media guide unit remaining connecting to the cover assembly to enable viewing of the default module media path and the at least one diverter-directed module media path.

10. A method of integrating printer subsystem components:

connecting a plurality of printer subsystem components to a frame of an integrated module, at least one printer subsystem component defining a default module media path and at least one diverter-directed module media path, the connecting of the printer subsystem components to the frame including:

connecting a cover assembly to the frame of the integrated module, the cover assembly having a media guide surface and a latch member, the cover assembly pivotally secured to the module frame to pivot between a first position in which the media guide surface forms a boundary of a first segment of the at least one diverter-directed module media path and a second position in which the cover assembly exposes the at least one diverter-directed module media path and the default module media path, the latch member is configured to secure the cover assembly in the first position selectively;

removably connecting a media guide unit to one of the cover assembly and the module frame, the media guide unit connected to one of the module frame and the cover assembly, the media guide unit having a plurality of media guiding surfaces, at least one of the media guiding surfaces forming the first segment of the at least one diverter-directed module media path with the media guide surface of the cover assembly;

connecting at least one movable diverter to one of the module frame and the media guide unit, the at least one movable diverter configured to direct a media sheet to a second segment of the diverter-directed module media path when in a first position and to direct a media sheet to one of the first segment of the diverter-directed module media path and the default module media path when in a second position; and connecting a diverter actuation system to one of the module frame and the media guide unit, the diverter actuation system configured to pivot the at least one movable diverter between the first position and the second position selectively;

connecting a first roller pair to the frame of the integrated module, the first roller pair having a first roller, a second roller, and a biasing member, the first roller coupled to a first actuator configured to rotate the first roller, the second roller secured to the cover assembly and mounted parallel to the first roller, and the biasing member configured to urge the second roller toward the first roller;

connecting a second roller pair to the frame of the integrated module, a second roller pair having a first roller, a second roller, and a biasing member, the first roller of the second roller pair coupled to a second actuator configured to rotate the first roller of the second roller pair, the second roller of the second roller pair secured to the module frame and mounted parallel to the first roller of the second roller pair, and the biasing member of the second roller pair configured to urge the second roller of the second roller pair toward the first roller of the second roller pair;

connecting at least one electrical connector to the frame of the integrated module, the at least one electrical connector configured to terminate a plurality of electrical signal conductors and to connect a plurality of electrical conductors utilized by the integrated module to the printer;

connecting at least one electrostatic charge reducing device to the frame of the integrated module, the at least one electrostatic charge reducing device configured to reduce the electrostatic charge on a media sheet;

connecting at least one dampener to the frame of the integrated module, the at least one dampener configured to cushion the at least one movable diverter as the diverter actuation system pivots the at least one movable diverter between the first position and the second position;

positioning the plurality of printer subsystem components connected to the integrated module within a printer by connecting the frame of the integrated module as a single unit to a predetermined space defined by a frame of the printer; and completing a printer media path through the predetermined space with the default module media path and the at least one diverter-directed module media path when the module frame having the at least one printer subsystem component is connected to the printer frame.

* * * * *